US006854476B1

(12) United States Patent
Chai

(10) Patent No.: US 6,854,476 B1
(45) Date of Patent: Feb. 15, 2005

(54) EASILY CONSTRUCTABLE AND COLLAPSIBLE PORTABLE TENTS

(75) Inventor: Tsangto Chai, Ma On Shan, N.T. (HK)

(73) Assignee: Winplus Company, Ltd., Shatin (HK)

( * ) Notice: Subject to any disclaimer, the term of this patent is extended or adjusted under 35 U.S.C. 154(b) by 0 days.

(21) Appl. No.: 10/092,852

(22) Filed: Mar. 5, 2002

(51) Int. Cl.[7] ..... E04H 15/36
(52) U.S. Cl. ..... 135/135; 135/98
(58) Field of Search ..... 135/135, 130, 135/128, 121, 15.1, 98, 907

(56) References Cited

U.S. PATENT DOCUMENTS

| | | | | |
|---|---|---|---|---|
| 2,864,389 A | * | 12/1958 | Smith et al. | 135/98 |
| 3,794,054 A | * | 2/1974 | Watts | 135/98 |
| 3,874,397 A | * | 4/1975 | Oberhaus | 135/98 |
| 4,304,068 A | * | 12/1981 | Beder | 135/117 X |
| 5,038,812 A | | 8/1991 | Norman | |
| 5,345,961 A | * | 9/1994 | Yercha et al. | 135/106 |
| 5,464,214 A | * | 11/1995 | Griffin | 312/7.2 X |
| 5,467,794 A | | 11/1995 | Zheng | |
| 5,560,385 A | | 10/1996 | Zheng | |
| 5,618,246 A | * | 4/1997 | Zheng | 135/126 X |
| 6,202,666 B1 | * | 3/2001 | Rehbein | 135/115 |
| 6,209,557 B1 | | 4/2001 | Zheng | |

FOREIGN PATENT DOCUMENTS

| | | | |
|---|---|---|---|
| GB | 2136845 | * | 9/1984 |

* cited by examiner

*Primary Examiner*—James O. Hansen
(74) *Attorney, Agent, or Firm*—Robert D. Buyan; Stout, Uxa, Buyan & Mullins, LLP

(57) ABSTRACT

A collapsible structure comprising a collapsible support structure having a flexible covering disposed thereon. The support structure comprises a plurality of pole members that emanate from an upper assembly. The upper assembly has first and second hub members that, when brought into abutting contact with each other, cause the structure to assume a fully constructed configuration but when separated from each other allow the structure to become collapsed. In many embodiments, the structure can be converted from its constructed configuration to its collapsed configuration substantially with the use of a single hand. In some embodiments, 2 or more of the collapsible structures may be joined together to form a multi-unit structure. These collapsible structures may include decorative markings on the flexible cover, especially in embodiments intended for use by or entertainment of children.

22 Claims, 6 Drawing Sheets

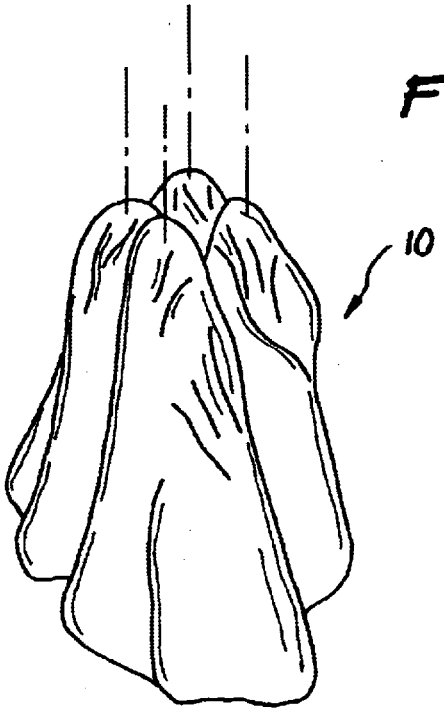
Fig. 2
Fig. 3
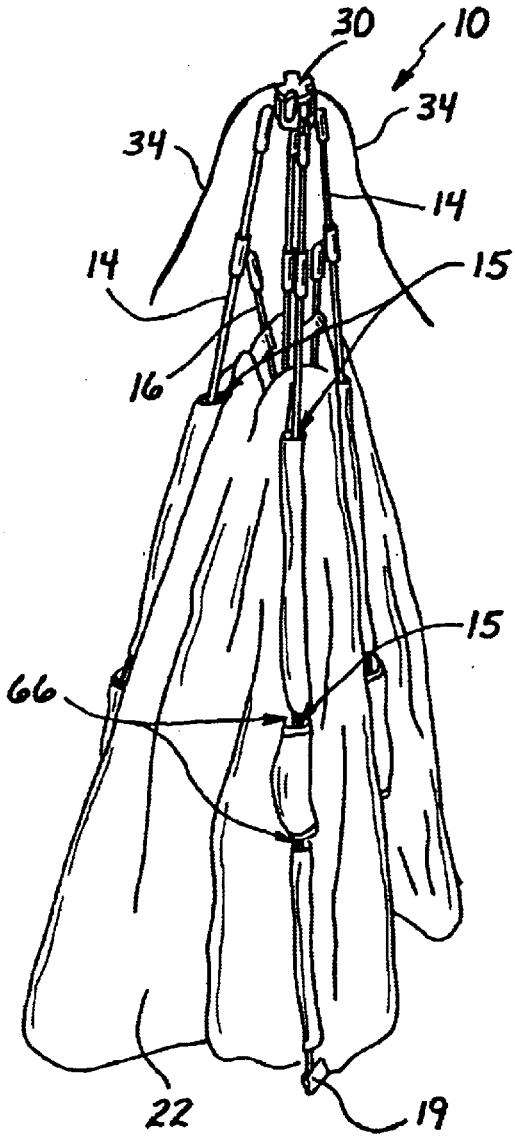
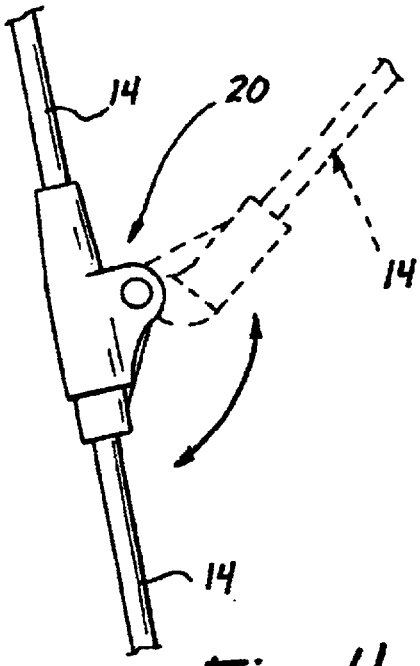
Fig. 4

Fig. 6
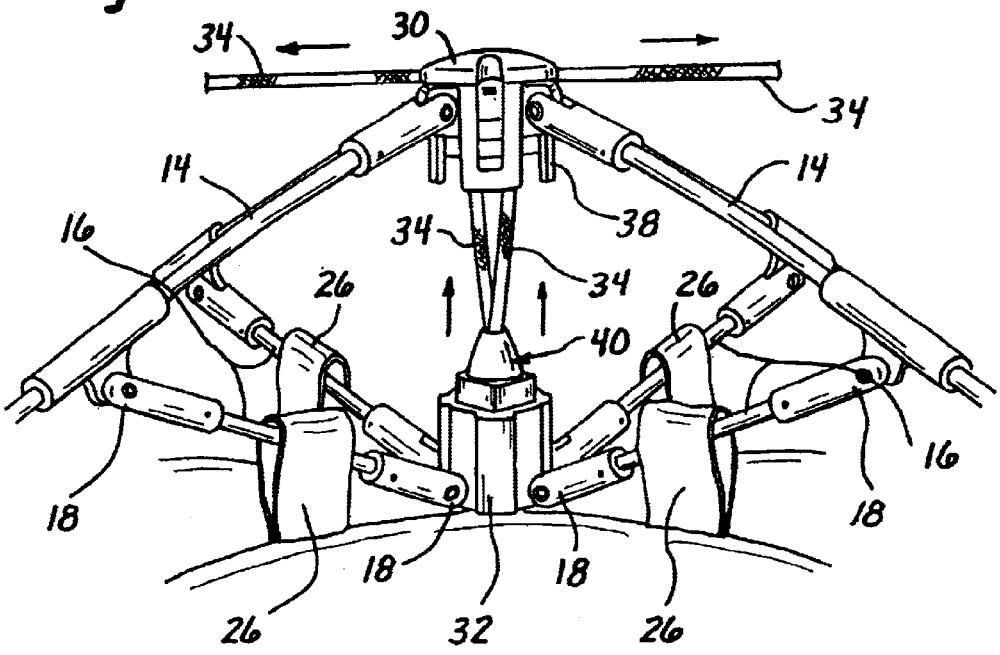
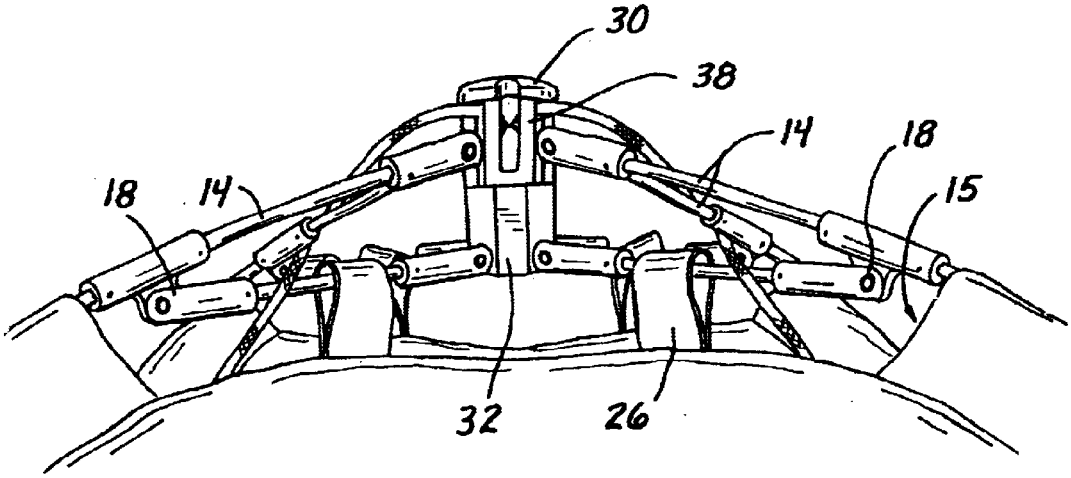
Fig. 7

EASILY CONSTRUCTABLE AND COLLAPSIBLE PORTABLE TENTS

FIELD OF THE INVENTION

This invention relates generally to collapsible structures and more particularly to portable tents that are constructed to be easily constructed and collapsed.

BACKGROUND OF THE INVENTION

A variety of portable tents and similar collapsible structures have heretofore been known, includint those described in U.S. Pat. No. 6,209,557 Zheng), U.S. Pat. No. 5,038,812 (Norman), U.S. Pat. No. 5,467,794 (Zheng) and U.S. Pat. No. 5,560,385 (Zheng). These portable tents and similar collapsible structures may be used by children or adults for temporary shelter, camping, as beach cabanas, play houses, etc.

The ease with which portable tents or other collapsible structures may be constructed and collapsed is a significant factor that determines their desirability for use in applications that require rapid or frequent construction and collapsing or easy portability, such as when these collapsible structures are used as beach cabanas, temporary play houses or while hiking, backpacking, rock climbing, etc.

Also, two or more portable tents or other collapsible structures are sometimes used in conjunction with one another and, in at least some applications, it may be desirable to connect two or more portable tents or other collapsible structures to one another to facilitate easy passage of humans, animals or objects from the interior of one structure to the interior of another structure.

Although the portable tents and similar collapsible structures have included a number of different designs, no one prior design is believed to be optimal and their remains a need in the art for the development of new and different portable tents and similar collapsible structures that are useable in new ways or are more easily collapsed/constructed or more easily portable than those of the prior art.

SUMMARY OF THE INVENTION

The present invention provides a collapsible structure (e.g., a tent, cabana, play hose, etc.) that generally comprises a plurality of pole members, a flexible covering disposed on the pole members, a plurality of strut members that are connected to the pole members and a hub assembly having upper and lower hub members, the hub assembly being attached to the pole members and the strut members. The structure is alternately disposable in a) a constructed configuration wherein the lower hub member is in abutment with the upper hub member and the flexible covering is drawn taut between the pole members and b) a collapsed configuration wherein the lower hub member is a spaced distance below the upper hub member, the pole members are closer together than they are when the structure is in its constructed configuration and the flexible covering is loosely disposed between the pole members.

Further in accordance with the invention, the strut members may be configured to exert an upward bias on the hub assembly when the structure is in its constructed configuration, thereby holding the hub members in substantially fixed vertical positions relative to one another and preventing the structure form inadvertently collapsing during use. When downward pressure is applied to the hub assembly, the upward bias of the strut memebrs is overcome, thereby releasing the hub assembly, allowing the upper and lower hub members to separate from one another and allowing the structure to assume its collapsed configuration.

Still further in accordance with the invention, the hub assembly may incorporate or be provided with locking structure(s) which mechanically lock the upper and lower hub members together when the structure is in its constructed configuration. These locating structures may be unlocked when it is desired to convert the structure to its collapsed configurations, thereby allowing the upper and lower hub members to move apart from one another and allowing the structure to assume the desired collapsed configuration.

Still further in accordance with the present invention, there are provided systems for attaching a plurality of collapsible structures of the forgoing type (or of any other type) to one another to form a multiple-structure assembly comprising a plurality of collapsible structures that are interconnects or linked to one another. Openings are formed in the individual collapsible structures and tunnel members are attachable to those openings so as to link the individual structures together and to provide enclosed or partially enclosed passageways between the individual collapsible structures that make up the multiple-structure assembly.

Still further in accordance with the present invention, collapsible structures of the forgoing type (or of any other type) may be provided with decorative markings or decorative items to impart entertaining or desired appearance(s) to the structure. For example, collapsible structures my have the appearance of a character (e.g., an animal or cartoon character). The decorative markings may be situated such that a door or flap which provides for passage into and out of the collapsible structure is positioned within an opening of the decorative object (e.g., the mouth of an animal or fish, the opening of a cave or volcano, etc.), thereby giving rise to the appearance that children or other users of the structure are passing into the opening of the decorative object as the enter the collapsible structure. In multi-unit embodiments, the decorative markings formed on each individual unit of the multi-unit assembly may fit together to give rise to a single decorative object (e.g. an elongate animal such as a snake or eel).

Further aspects and elements of the present invention will be appreciable to those of skill in the art upon reading the detailed descriptions of embodiments set forth herebelow.

BRIEF DESCRIPTION OF THE DRAWINGS

FIG. 2 is a perspective view of the collapsible structure of FIG. 1 in its collapsed state, immediately after removal from its optional carrying case.

FIG. 3 is a perspective view of the collapsible structure of FIG. 2 in a partially constructed yet still partially collapsed state.

FIG. 4 is an enlarged view of portion 4–4 of FIG. 3.

FIG. 6 is a perspective view of the top portion of the collapsible structure of FIGS. 1–5 in a nearly fully constructed state.

FIG. 7 is a perspective view of the top portion of the collapsible structure of FIGS. 1–5 in its fully constructed state.

DETAILED DESCRIPTION OF EXEMPLARY EMBODIMENTS

The following detailed description is provided for the purpose of describing only selected embodiments or examples of the invention and is not intended to describe all possible embodiments and examples of the invention.

Figure 1:
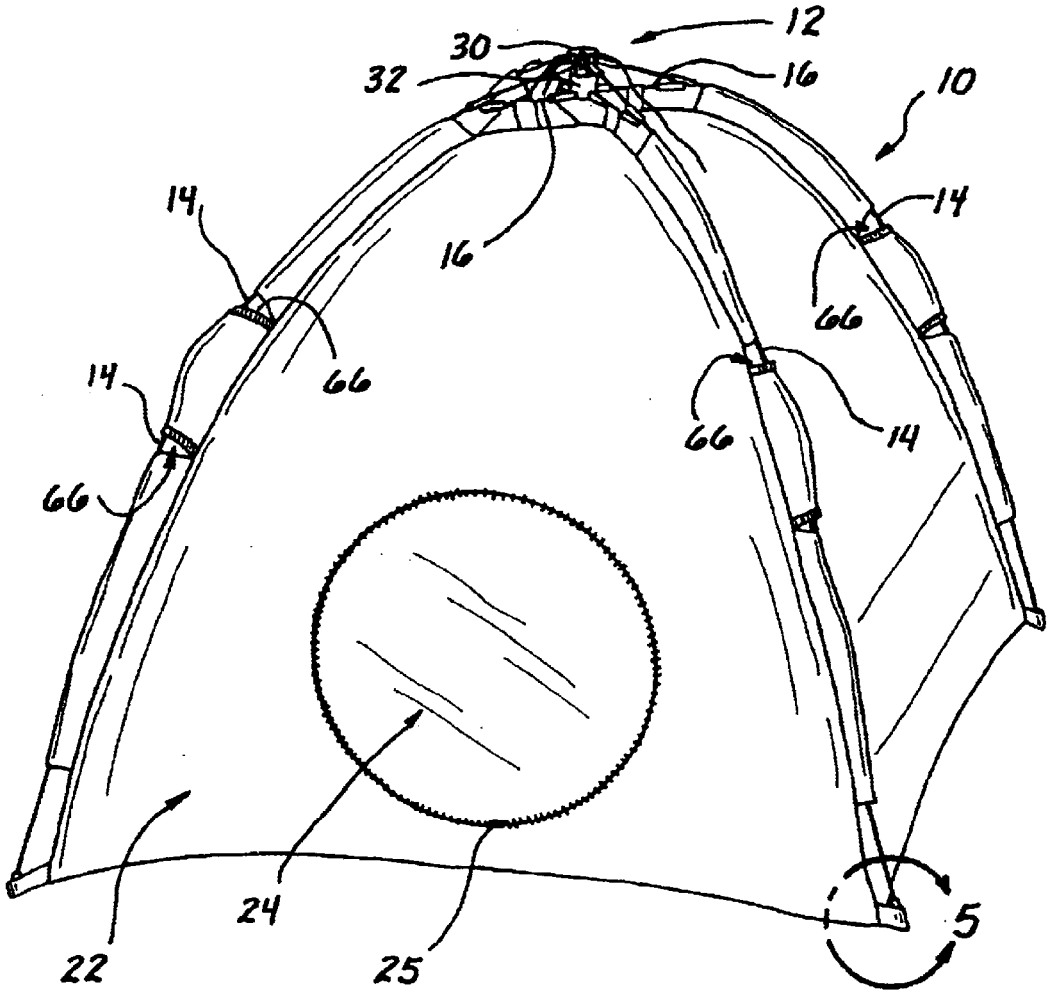
FIG. 1 is a perspective view of a collapsible structure of the present invention in its fully constructed state.
Figure 12:
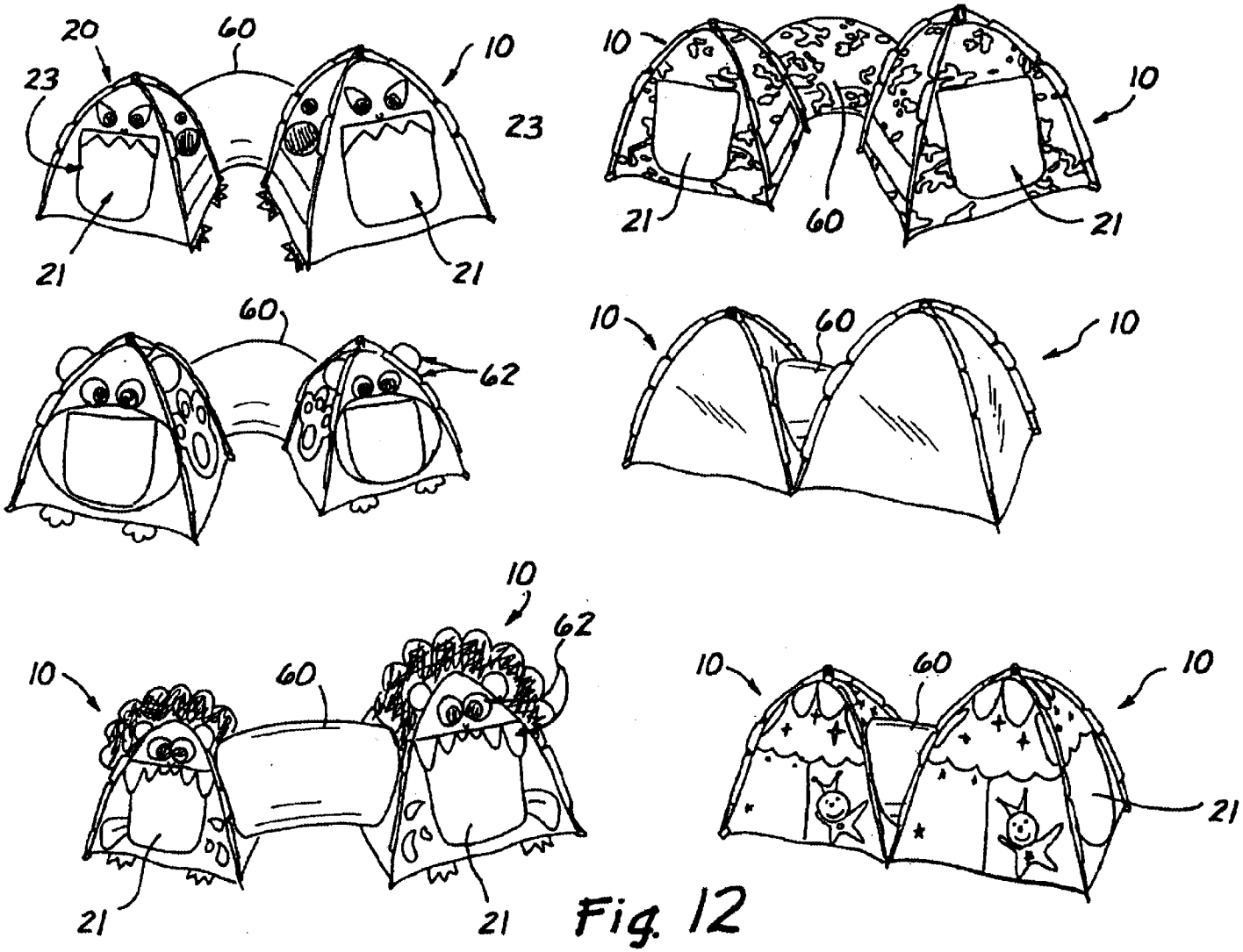
FIG. 12 is a collection of perspective views of multiple unit embodiments oc the persent invention with and without decorative markings formed thereon.

FIGS. 1 and 12 show an examples of a collapsible structures 10 of the present invention in their fully constructed configurations. As shown in FIG. 1, each collapsible structure 10 generally comprises a) a support frame formed of a plurality of pole members 14, a plurality of strut members 16 and upper and lower hub members 38,32 and b) a flexible covering 22 formed of woven nylon, plastic sheet or similar material. As shown in FIG. 12, flexible covering 22 has a flap opening 21, such flap 21 being securable in a closed position by a zipper 23.

Optionally, as shown in FIG. 1, a removable panel 24 may be formed in the flexible cover 20 to and such removable panel 24 may be secured to the flexible cover by a zipper 25. When the removable panel 24 is removed and opening is formed in the flexible cover 22 of the collapsible structure 10. As shown in FIG. 12, and optional tunnel members 60 may be used in conjunction with two of the collapsible structures 10 that have optional removable panels 24 to form a multi-unit collapsible structure. The optional total member 60 preferably comprises a to the formed of flexible material such as woven by a line, plastic sheet or other suitable material. Zippers may be formed around the either end of the tunnel member 60 and may be mated or meshed with the portions of the zippers 25 that remainin on the flexible covers 22 of the collapsible structures 10 after their optional removable panels 44 have been removed. In this manner, one end of a tunnel member 60 may be connected to an opening formed in one collapsible structure 10 and the other end of that tunnel member may be connected to an opening formed in another collapsible structure 10, thereby forming a multi-unit collapsible structure wherein the tunnel member 60 acts as a passageway between two collapsible structures 10. Although the embodiments shown in FIG. 12 utilize only two collapsible structures 10, it will be appreciated that more than one removable panel 24 may be formed in some collapsible structures 10 and three or more of the collapsible structures 10 may be joined by tunnel members 60 to form multi-unit collapsible structures of this invention that incorporate more than two of the individual collapsible structures 10 of the type shown in FIG. 1.

Also, and shown in FIG. 12, decorative markings 62 may be formed on the flexible covers 22 and/or on the optional tunnel members 60 to impart a desired appearance. These optional decorative markings 62 may be used on single-unit or multi-unit collapsible structures 10 of this invention and may be particularly desirable when the collapsible structures 10 are intended for use as children's beach cabanas, children's playhouses, doll houses or otherwise for the entertainment of children. In these types of applications, it may be desirable for the decorative markings 62 to impart the appearance of an insect or animal. In this regard, the decorative markings 62 may be in the nature of facial features such as eyes, nose and mouth and the opened mouth of the creature may appear around the entry flap 21 of a collapsible structure 10 to give the appearance of entering through the mouth of the creature as a child passes through the entry flap 21.

The collapsible structures 10 of the present invention may be easily constructed and easily collapsed and folded to a stowable configuration. When in their fully collapsed states, the collapsible structures may be inserted in two caring cases or bags. A desired carrying case (not shown) comprises a light weight, woven nylon case that has carrying handles and a zipper for opening and closing the carrying case.

Figure 5:
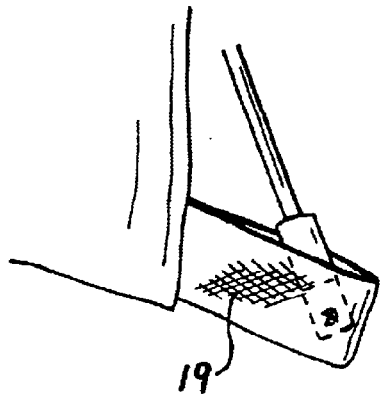
FIG. 5 is an enlarged view of portion 5—5 of FIG. 3.
Figure 9:
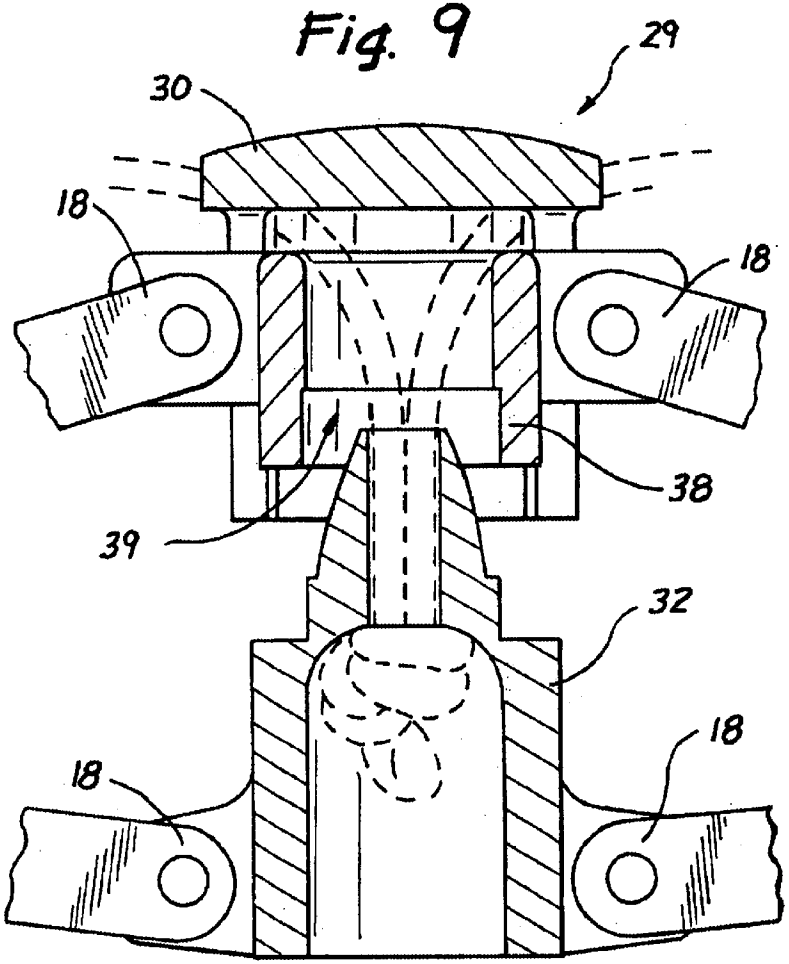
FIG. 9 is another sectional view taken vertically through the upper and lower hub members of the upper assembly of the collapsible structure shown in FIG. 1.

To fully appreciate the manner in which the collapsible structure 10 may be constructed and collapsed, it is helpful to consider and understand the components, design and function of the support structure and the manner in which the flexible cover 22 is disposed upon the support structure. The support structure generally comprises a plurality of pole members 14, a plurality of strut members 16 which extend through loops 26, a hub assembly 29 comprising an upper hub member 38, a lower hub member 32 and an actuator 30. The pole members 14 extend through elongate receiving channels 15 formed in the corners of the flexible cover 22 and the bottom ends of the pole members 14 are inserted into tabs 19 that are attached to and extend from the bottoms of the corners of the flexible cover 22. Each tab preferably comprises a pocket formed of durable fabric and having an opening in its top edge such that the bottom end of a pole member 14 may be received within the pocket as shown in FIG. 5. When the structure 10 is collapsed, as shown in FIGS. 2 and 3, the pole members 14 are substantially straight, the upper and lower hub members 38, 32 are separated and spaced apart, and the flexible cover 22 is loosely disposed. Also, hinged joints 20, as shown in FIG. 4, are formed in the pole members 14 approximately midway along their length. When the hinged joints 20 are extended as shown in FIG. 3, they reside within the receiving channels 15 of the cover 22 between notches or cut out areas 66 formed in the fabric that defines the channels 15. These hinged joints 20 may be folded over in the manner shown in FIG. 2 to further collapse the structure 10. The presence of the notches or cut away areas 66 facilitates such folding of the pole members 14 at their hinged joints 20 by preventing the fabric of the cover 22 that forms the channels 15 from bunching or binding the hinged joints 20.

Figure 8:
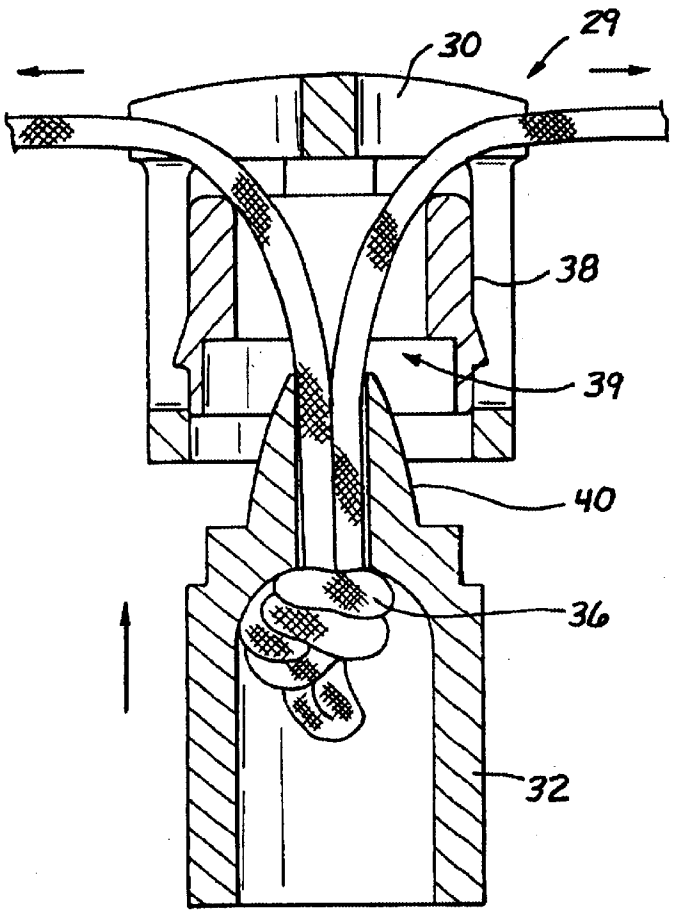
FIG. 8 is sectional view taken vertically through the upper and lower hub members of the upper assembly of the collapsible structure shown in FIG. 1.
Figure 10:
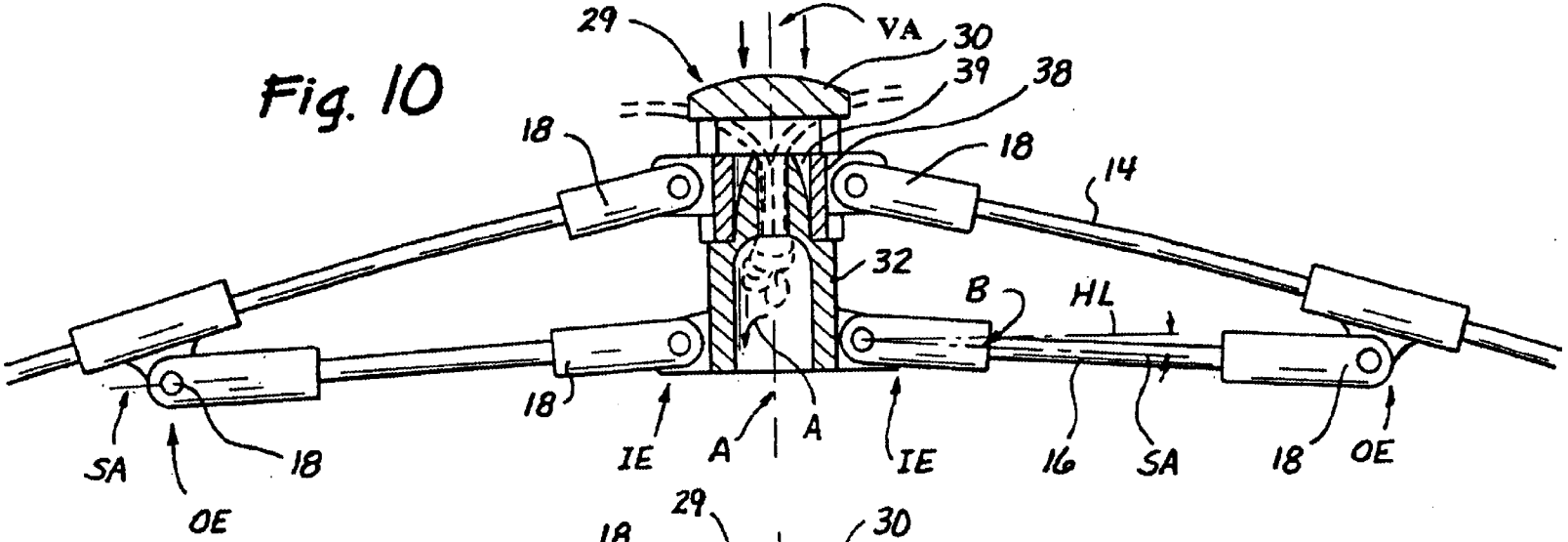
FIG. 10 is a sectional view taken vertically through the upper and lower hub members of the upper assembly of the collapsible structure shown in FIG. 1 while in its locked in its constructed configuration.

The process of converting the collapsible structure 10 from its collapsed configuration shown in FIG. 2 to its constructed configuration shown in FIG. 1 begins with unfolding of the hinged joints 20 to convert the fully collapsed structure shown in FIG. 2 to a partially collapsed states as shown in FIG. 3. Thereafter, with the bottom ends of the pole members 14 inserted into their receiving tabs 19, the user may grasp the free ends of the two cords 34, pulling them in opposite, horizontal, outward directions as illustrated in FIG. 6. The cords 34 are knotted within the lower hub member 32 as shown in FIG. 8. Thus, as the cords 34 are pulled outwardly, the lower hub member 32 will be drawn upwardly toward the upper hub member 38 such that the upper projecting portion 40 of the lower hub member 32 will be received within a bore or concavity 39 formed in the upper hub member 38, and the upper and lower hub members 38, 32 will be in abutting contact with one another. Also, as shown in FIG. 10, when the lower hub member 32 reaches its uppermost position in full abutment with the upper hub member 38, the inner ends IE of strut members 16 may be slightly elevated above the outer ends OE of the strut members 16 and such upward slanting of the strut members will serve to exert a biasing force in the upward direction against the lower hub member holding it in abutting contact with the upper hub member 30 even after the user releases the cords 34. Also, as the tub members 38, 32 are pulled into abutting contact with each other, the pole members 14 will bow to an arcuate configuration, giving the fully constructed structure 10 the configuration shown in FIG. 1.

Figure 11:
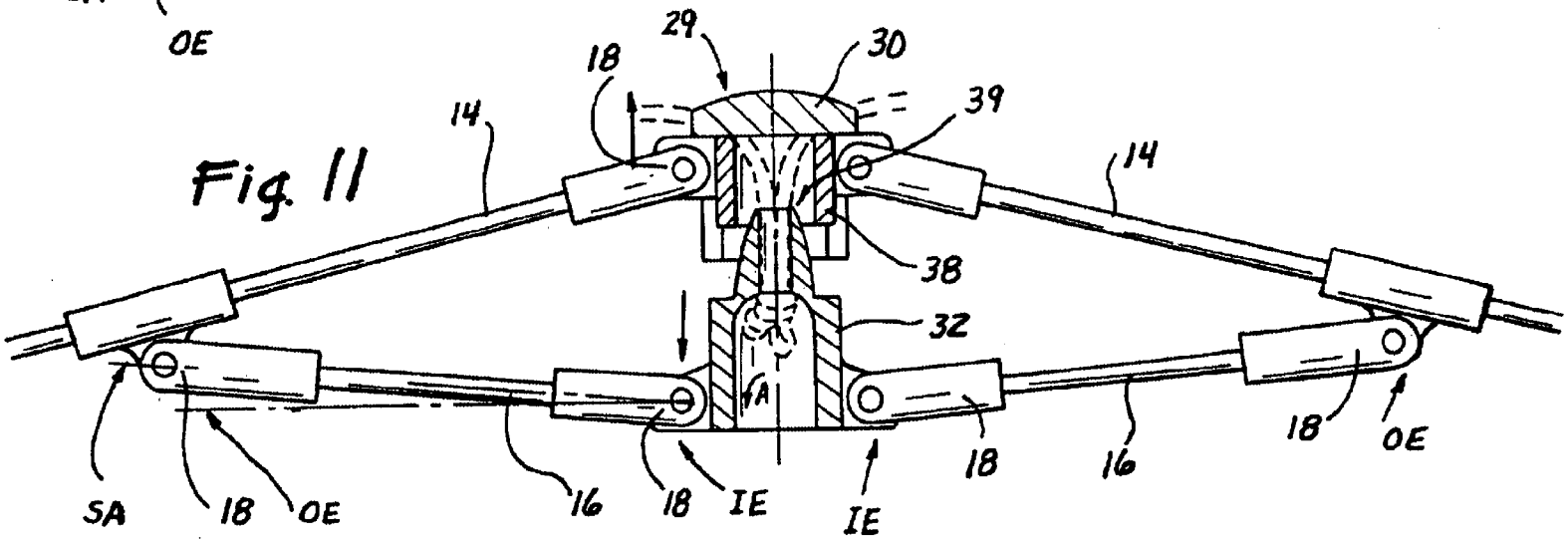
FIG. 11 is a sectional view taken vertically through the upper and lower hub members of the upper assembly of the collapsible structure shown in FIG. 1 after downward pressure has been applied to the upper hub member so as to cause the lower hub member to separate from the upper hub member and causing the structure to begin to transition from its constructed configuration to its collapsed configuration.

When it is desired to return the structure to its collapsed state, the user may simply push downwardly on the actuator knob 30 to flex the upper assembly 12 and poles 14 downwardly to a position where the inner ends IE of the strut members 16 are now lower than the outer ends OE of those strut members 16. This results in a loss of the upward bias on the lower hub member 32 and allows the lower hub member 32 to separate from the upper hub member 30, as shown in FIG. 11. The structure may then be picked up vertically by the actuator knob 30 without constraining or preventing free retraction of the cords 34 and the structure will assume the partially collapsed configuration shown in FIG. 3. Thereafter, the hinged joints 20 may be folded over to place the structure 10 in its fully collapsed state as shown in FIG. 2. The fully collapsed structure may then be placed in an optional carrying case (not shown) or otherwise carried or transported with ease.

As shown in FIGS. 10 and 11, when the hub assembly 29 is vertically situated, a hub axis, which in the drawings is shown as a vertical axis VA, is projectable through the center of upper and lower hub members 38, 32. Also, a strut axis SA is projectable through each of the strut members 16. An internal angle A is definable between the strut axis SA and the vertical axis VA. When the structure 10 is locked in the constructed configuration shown in FIG. 10, angle A is more than 90 degrees and the outer ends OE of the strut members 16 are lower than or below the inner ends IE of the strut members 16. When the structure 10 is in the unlocked configuration shown in FIG. 11 (e.g., as it is being collapsed or constructed), angle A is less than 90 degrees and the outer ends OE of the strut members 16 are above or higher than the inner ends IE of the strut members.

In alternative embodiments, an alternative hub assembly may be utilized to mechanically or frictionally lock the structure 10 in its constructed configuration without requiring angle A to be more than 90 degrees and without requiring the outer ends OE of the strut members 16 to be above or higher than their inner ends IE.

An alternative hub assembly is useable in embodiments where the internal angle A between the strut axis SA and the vertical axis VA is less than or equal to 90° when the structure is in its fully opened or fully constructed configuration. In this alternative hub assembly, one or more downwardly extending legs are formed on an actuator cap and the actuator cap is at least partially rotatable. Receiving slots are formed in the downwardly extending legs and protruding keys are slidably received within the receiving slots to stabilize and guide the up and down motion of the actuator cap. The corner surface of each leg contacts a protruding key formed on the lower hub member. A side slot is also formed on a lower portion of a leg to receive another key member that protrudes from the lower hub member. When it is desired to convert the structure from its open or constructed configuration to its collapsed configuration, the actuator cap is turned in the counter-clockwise direction to a position wherein one of the keys resides within the slot adjacent to but not within a locking side slot, and the other key resides adjacent to but not within the other slot. The actuator cap is pressed downwardly to exert downward force on the lower hub member, causing the lower hub member to separate from upper hub member, and allowing the structure to assume its collapsed configuration. When it is desired to convert the structure from its collapsed configuration back to its open or constructed configuration, the various elements of the structure will be manipulated into a configuration whrerein the hub assembly is once again in its open or constructed configuration. Thereafter, the actuator cap is turned in the clockwise direction causing one key to slide into locking side slot, and the other key to slide into the slot, thereby locking the upper and lower hub members in fixed vertical positions relative to one another and preventing the structure from inadvertently collapsing during use.

Another alternative hub assembly is useable in embodiments where, when the structure is in its fully opened or fully constructed state, the internal angle A between the strut axis SA and the vertical axis VA is greater than 90°. In this alternative hub assembly, one or more downwardly extending legs are formed on actuator cap. When the user presses downwardly on the actuator cap, the legs extend downwardly into abutment with s flange on the lower hub member. Slots are formed in the legs and protruding keys are slidably received within the slots, thereby guiding the up and down motion of the actuator cap.

Although exemplary embodiments of the invention have been shown and described, many changes, modifications and substitutions may be made by those having ordinary skill in the art without necessarily departing from the spirit and scope of this invention. Specifically, elements or attributes described in connection with one embodiment may also be used in connection with another embodiment provided that the inclusion or use of such element or attribute would not render the embodiment in which it is incorporated unuseable or otherwise undesirable for an intended application. Accordingly, all such additions, deletions, modifications and variations to the above-described embodiments are to be included within the scope of the following claims.

What is claimed is:

1. A collapsible structure comprising:

a plurality of pole members having top ends and bottom ends;

an upper hub member to which the top ends of the pole members are pivotally attached;

a lower hub member positioned beneath the upper hub member;

a plurality of strut members having inner and outer ends, the outer end of each strut member being pivotally attached to an pole member and the inner end of each strut member being pivotally attached to the lower hub member; and, a flexible covering disposed upon and traversing between the pole members;

said structure being alternately disposable in a) a constructed configuration wherein the lower hub member is in abutment with the upper hub member and the flexible covering is drawn taut between the pole members and b) a collapsed configuration wherein the lower hub member is a spaced distance below the upper hub member, the pole members are closer together than they are when the structure is in its constructed configuration and the flexible covering is loosely disposed between the pole members;

said structure further comprising first and second pull cords attached to the lower hub member and extending through openings formed at diametrically opposing locations in the upper hub member such that pulling of the first and second pull cords in opposite lateral directions will pull the lower hub member upwardly into abutting contact with the upper hub member and will cause the inner ends of the strut members to elevate to positions that are above the outer ends of the strut members such that the structure will be retained in its constructed configuration;

wherein, when the structure is in its constructed configuration, pressing downwardly on the top of the hub assembly will cause the upper and lower hub members to separate from one another and the structure to assume its collapsed configuration.

2. A collapsible structure according to claim 1 further comprising hinged joints formed in the pole members between their upper and lower ends such that the pole members may be folded when the structure is in its collapsed configuration.

3. A collapsible structure according to claim 1 wherein the inner ends of the strut members are elevated above the outer ends of the strut members when the structure is in its constructed configuration, thereby exerting an upward bias on the lower hub member and retaining the structure in its constructed configuration.

4. A collapsible structure according to claim 3 wherein the application of downward pressure on the upper hub member causes the inner ends of the strut members to move to positions that are below the outer ends of the strut members, thereby over coming the upward bias on the lower hub member and allowing the structure to transition to its collapsed configuration.

5. A collapsible structure according to claim 1 further comprising at least one pull cord attached to the lower hub member and extending upwardly through the upper hub member such that pulling on the pull cord pulls the lower hub member upwardly into abutting contact with the upper hub member and causes the inner ends of the strut members to elevate to positions that are above the outer ends of the strut members such that the structure will be retained in its constructed configuration.

6. A collapsible structure according to claim 1 wherein the flexible covering comprises plastic sheet.

7. A collapsible structure according to claim 1 wherein the flexible covering comprises woven fabric.

8. A collapsible structure according to claim 1 wherein the flexible covering is disposed on the strut members such that when the structure is in its constructed configuration the strut members will support at least a portion of the flexible covering.

9. A collapsible structure according to claim 1 wherein receiving channels are formed in the flexible covering and the pole members extend through the receiving channels such that the flexible covering is disposed upon and substantially supported by the pole members when the structure is in its constructed configuration.

10. A collapsible structure according to claim 9 wherein hinged joints are formed in the pole members at locations between their top ends and their bottom ends and wherein cut-out regions are formed in the receiving channels to facilitate folding of the pole members at the hinged joints when the structure is in its collapsed configuration.

11. A collapsible structure according to claim 1 wherein the bottom ends of the pole members are received within receiving tabs formed at the bottom of the flexible covering.

12. A collapsible structure according to claim 11 wherein the receiving tabs comprise pockets of material attached to the flexible covering, each said pocket of material having an opening into which the bottom end of a pole member is inserted.

13. A collapsible structure according to claim 1 wherein the pole members bow to an accurate configuration when the structure is in its constructed configuration.

14. A collapsible structure according to claim 1 further comprising an entry opening formed in the flexible covering to permit entry into and exit from the interior of the collapsible structure when it is in its constructed configuration.

15. A collapsible structure according to claim 14 further comprising a flap that is securable over the entry opening to close said entry opening when not in use.

16. A collapsible structure according to claim 1 further comprising at least one opening in the flexible covering, said opening being covered by a removable panel.

17. A collapsible structure according the claim 16 wherein the removable panel is attached to the flexible covering by way of a zipper.

18. A collapsible structure comprising a) at least two collapsible structures according to claim 16 in combination with b) at least one tunnel member that has a first end and a second end and a passageway extending therethrough, the first end of said tunnel member being attachable to an opening created by removal of the removable panel from one collapsible structure and the second end of said tunnel member being attachable to an opening created by removal of the removable panel from another collapsible structure.

19. A collapsible structure according to claim 18 further comprising decorative markings formed on the outside of the flexible covering of at least one of the collapsible structures.

20. A collapsible structure according to claim 1 further comprising decorative markings formed on the outside of the flexible covering.

21. A collapsible structure according to claim 20 wherein the decorative markings impart the appearance of an animal or insect to the collapsible structure when in its constructed configuration.

22. A collapsible structure according to claim 21 wherein an entry opening is formed in at least one of the collapsible structures and the decorative markings create the appearance of an open mouth about the entry opening.

* * * * *